United States Patent [19]

Tanaka et al.

[11] 4,053,770

[45] Oct. 11, 1977

[54] A.C. CORONA DISCHARGING DEVICE

[75] Inventors: Hiroshi Tanaka, Tokyo; Shinkichi Takahashi, Kinata; Touru Takahashi; Shusei Tsukada, both of Tokyo; Giichi Marushima, Komae, all of Japan

[73] Assignee: Canon Kabushiki Kaisha, Tokyo, Japan

[21] Appl. No.: 779,581

[22] Filed: Mar. 21, 1977

Related U.S. Application Data

[63] Continuation of Ser. No. 8,270, Feb. 3, 1970, abandoned.

[51] Int. Cl.[2] ..... G03G 15/00

[52] U.S. Cl. ..... 250/324; 361/213

[58] Field of Search ..... 317/262 A; 250/324, 250/325, 326

[56] References Cited

U.S. PATENT DOCUMENTS

| | | | |
|---|---|---|---|
| 2,885,556 | 5/1959 | Gundlach | 250/324 |
| 3,076,092 | 1/1963 | Mott | 250/324 |
| 3,220,324 | 11/1965 | Snelling | 250/324 |
| 3,233,156 | 2/1966 | Jarvis | 250/324 |
| 3,396,308 | 8/1968 | Whitmore | 250/324 |
| 3,496,352 | 2/1970 | Jugle | 250/324 |

*Primary Examiner*—Craig E. Church

*Attorney, Agent, or Firm*—Fitzpatrick, Cella, Harper & Scinto

[57] ABSTRACT

An A.C. corona discharging device for use in the process in which discharge and exposure are accomplished contemporaneously has insulating members disposed so as to surround the discharge wire or electrode and define the opening for projecting the image of an original. The potential gradient is increased, the discharge efficiency is improved and the flow of useless current which heretofore traveled through the shielding electrode is not encountered.

8 Claims, 14 Drawing Figures

A.C. CORONA DISCHARGING DEVICE

This is a continuation of application Ser. No. 8,270, filed Feb. 3, 1970 now abandoned.

The present invention relates to a discharging device for electrophotography and more particularly to an A.C. corona discharging device for use in a process in which discharging and exposure are performed contemporaneously.

A contemporaneous discharging-exposure process for electrophotograpy is, for example, in the copending U.S. application Ser. No. 571,538 filed Aug. 10, 1966. This process comprises the steps of uniformly charging the surface of an insulating layer of a photosensitive member consisting of a base, a photoconductive layer and said insulating layer so as to bind a charge having a polarity opposite to that of said charging polarity at the interface between said photoconductive layer and said insulating layer or within said photoconductive layer; thereafter projecting the image of an original contemporaneously with an A.C. corona discharge thereby forming an electrostatic image of said original in the form of surface potential differences as a function of the pattern (the dark and light areas) of the original; and thereafter, if necessary, exposing said photoconductive layer to radiation thereby increasing the contrast of said electrostatic image upon the surface of the insulating layer.

As a device for applying the A.C. corona discharge contemporaneously when the image of an original is projected in electrophotography, there has been known a device in which a discharge electrode is disposed between electrically conductive shielding plates whose lower side edges (the edges nearest the photosensitive members) define the width of the exposure slit or aperature. The upper portions of the shielding plates are spaced apart so that the image of the original may be projected through this space or opening. Alternatively the upper opening is shielded by use of a transparent electrode such as wires or NESA glass.

In the A.C. corona discharging device of the type described above, the electrically conductive shield is grounded so that the potential gradient cannot be raised above the applied voltage, resulting in poor efficiency. Furthermore, an undesired current flows through the shielding plate surrounding the discharge electrode so that the known device is not advantageous from the point of economy. At the lower end of the shield where the slit is defined, ions will not reach the photosensitive plate but will be attracted by the shielding plate so that the effective charging slit width becomes exceedingly narrower than the width of the exposure slit. This has been confirmed by experiments. Therefore, during exposure the light is wasted adjacent both sides of the slit so that the apparent sensitivity is decreased.

The present invention provides an A.C. corona discharging device for use in a contemporaneous charging-exposure process for electrophotography in which a corona discharge wire is surrounded by an insulating member having an opening between spaced side walls through which an image is projected.

When the corona discharge wire is coupled to an A.C. power source the insulating member is alternately positively and negatively charged durning each half-cycle so that the potential gradient is increased, resulting in higher discharge efficiency. Furthermore, the insulating member itself is especially designed or special means are disposed in the vicinity of the insulating member so that the width of the effective opening for discharging can be made equal to that of the slit width for exposure. The conventional shield electrode plate is not used so that no current flows therethrough, whereby a smaller and inexpensive power supply can be advantageously used. Thus, all of the defects encountered in the previously known device can be eliminated.

Therefore, the primary object of the present invention is to provide an A.C. corona discharging device for use in electrophotography.

Another object of the present invention is to provide an A.C. corona discharging device for use in a contemporaneous charging-exposure process for electrophotography.

A further object of the present invention is to provide an A.C. corona discharging device having an extremely high efficiency.

A still another object of the present invention is to provide an A.C. corona discharging device in which an electrically conductive shield plate is not used but an electrically insulating member is used thereby eliminating waste of current and enabling the use of a smaller and inexpensive power supply.

A yet another object of the present invention is to provide an A.C. corona discharging device in which the width of the slit for discharging may be easily made coincident with the width of the slit for exposure, thereby increasing the sensitivity of the photosensitive member.

The above and other objects, features and advantages of the present invention will become more apparent from the description of the illustrative embodiments thereof taken in conjunction with the accompanying drawings in which.

Figure 1:
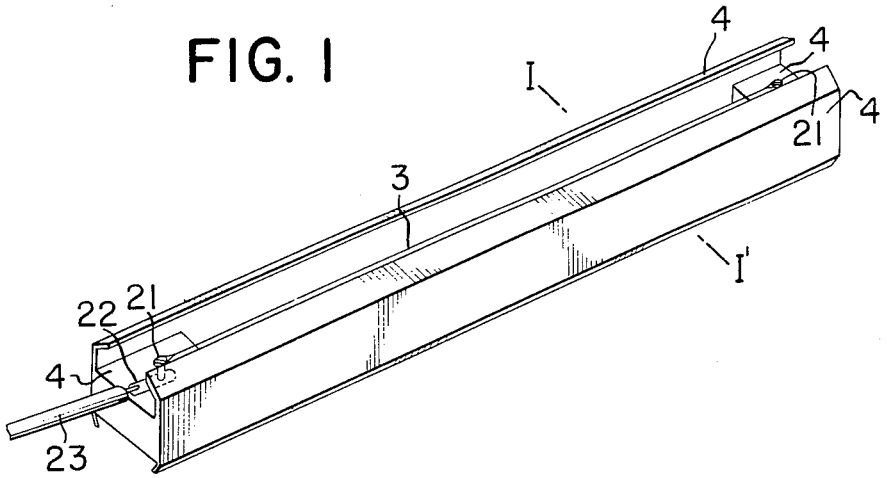
FIG. 1 is a perspective view of one embodiment of the A.C. corona discharging device of this invention for use in a contemporaneous discharge - exposure process of electrophotography.
Figure 2:
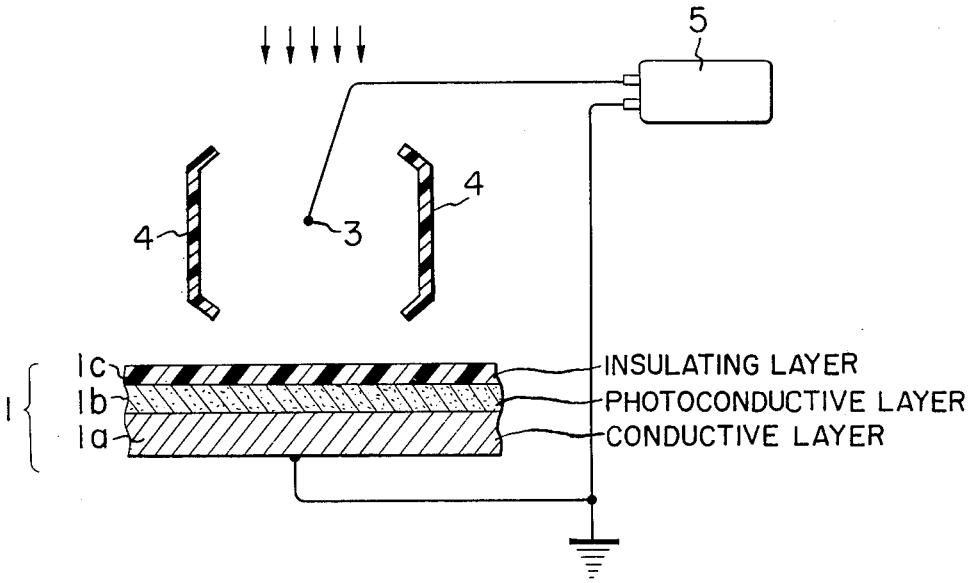
FIG. 2 shows a cross section of the embodiment of FIG. 1 taken along the line I–I'.

FIGS. 1 and 2 illustrate an A.C. corona discharging device in accordance with the invention for use in a process in which discharging and exposure are effected contemporaneously. The discharging device may be used for example in the process disclosed in the copending application Ser. No. 571,538. The process comprises the steps of uniformly charging the surface of an insulating layer of a photosensitive member which is fundamentally comprised of a base, a photoconductive layer and said insulating layer so that a charge of opposite polarity to that of said charging polarity may be bound at the interface between the photoconductive and insulating layers or in the photoconductive layer; thereafter projecting the image of an original while contemporaneously applying A.C. corona discharge thereto; and exposing the photoconductive layer to radiation, thereby forming upon the surface of the insulating layer an electrostatic image of the original having high contrast.

A photosensitive plate 1 comprises a laminated assembly of a base 1*a*, a photoconductive layer 1*b* and an insulating layer 1*c*. A corona discharge wire 3 is electrically coupled to an A.C. power source 5 through a lead wire. An insulating member 4 is disposed with the corona discharge wire 3 between its spaced side walls and has the upper portion remote from said plate 1 opened optically. The other terminal of the A.C. power source 5 is coupled to the base 1a of the plate 1 through a lead wire and may be grounded as shown. The insulating member 4 can be made of polycarbonate, ABS resins, acrylic resins, tetrafluorethylene resin, polyethylene, etc.

After the primary charging, a high voltage is applied from the A.C. power source 5 across the corona discharge wire 3 and the base 1*a* contemporaneously with projection of an image upon the plate 1, so that a positive polarity corona discharge takes place durning the positive cycle of the A.C. high voltage, whereby both the plate 1 and the insulating member 4 are charged positively. Next the corona discharge wire 3 is negatively charged so that a negative polarity corona discharge occurs. In this case, since the insulating member 4 is positively charged, the field between the corona discharge wire 3 and the insulating member 4 is more intense than when the member 4 is entirely conductive. Thus, a more effective corona discharge can be effected. Furthermore, the negative polarity corona first neutralizes the positive charge upon the insulating member 4 and thereafter the insulating member 4 is negatively charged. Thereupon, this negative charge on the insulating member 4 serves effectively in the production of the positive corona discharge in the next half cycle. The above described positive and negative corona discharges alternate so that the corona discharge is produced more effectively as compared with the case where only a conductive shielding plate is provided. A high frequency power source may be used as the A.C. power source.

Figure 3:
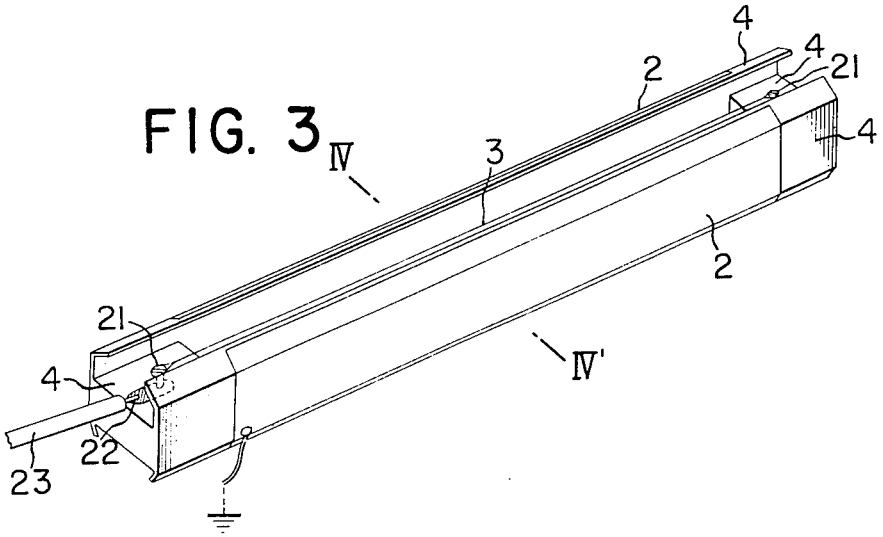
FIG. 3 is a perspective view of another embodiment in which a grounded conductive shielding plate is provided around the insulating material of the discharger of FIG. 1.
Figure 4:
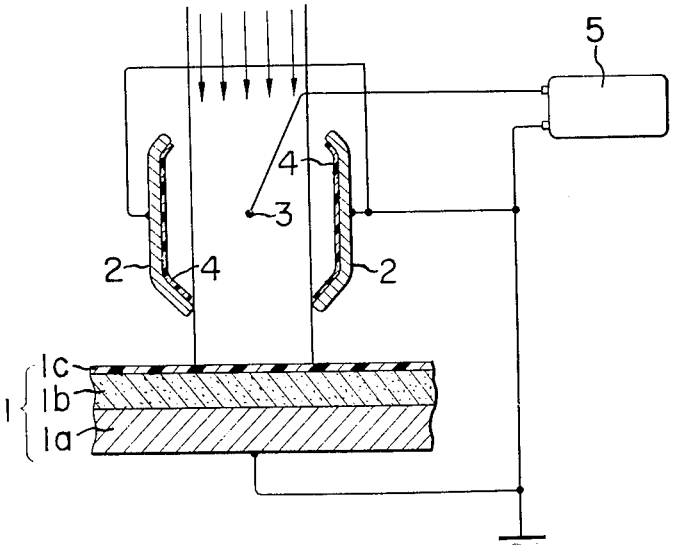
FIG. 4 is a cross section of the discharger of FIG. 3 taken along the line IV–IV'.

Next referring to FIGS. 3 and 4, a second embodiment of the present invention will be described hereinafter. In this second embodiment, the exterior of the insulating member 4 is covered with a conductive shielding plate 2 which is i.e., connecting to a point of reference potential. The mode of corona discharge operation is substantially similar to that of the first embodiment described with reference to FIGS. 1 and 2. However, it should be noted that the discharge efficiency is further increased as compared with the first embodiment. Namely, when only insulating material is used, the capacity to ground is small so that saturation quickly occurs however, in the embodiment shown in FIGS. 3 and 4, the capacity to ground is greater than of that in FIGS. 1 and 2, the discharge current is increased, and the efficiency is improved.

Figure 5:
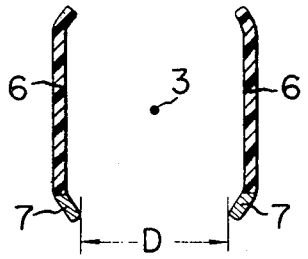
FIG. 5 shows a further embodiment of this invention in which a metallic shield member is provided at the lower portion of the insulating material of FIG. 1.

In the third embodiment illustrated in FIG. 5, metallic shielding members 7 are attached to the lower edges of the side walls 6 of the insulating member 4 in FIG. 1. The discharge wire 3 is disposed between the insulating side walls 6. The shielding members 7 provided for grounding are spaced apart from each other by a suitable distance D for exposure. The shielding members 7 may be made of any metal and in the instant embodiment are in the form of metal plates.

Since the sensitivity of the photosensitive plate 1 used in the present invention is very high, the spacing between the shielding members 7, 7 may be very small as compared with a conventional charging device and may be, for example, of the order of 10 to 4 mm when the image is projected by scanning at a speed of 10cm/sec. In such case, the discharging or charging time for the secondary charging is only of the order of 0.1 to 0.04 sec. In order to accomplish charging or discharging within such short time, the corona current must be increased by raising the voltage, but with a conventional shield only 10% of the current would reach the photosensitive plate 1 while the remaining 90% would flow through the conductive shield electrode and be wasted. Thus, the capacity of the power source must be increased and a conventional A.C. corona discharge device is disadvantageous from an economical point of view.

In the instant embodiment, the insulating shield plates or members 6, 6 are provided at both sides of the discharge electrode 3 having optically opened upper portion and lower grounded shield members 7, 7 with exposure width D, so that when the voltage of the power source is increased, undesired current flow through the shielding member 6 is substantially avoided so that the current that does flow is effectively and advantageously used only for charging or discharging. Thus, the power source may have less capacity and be inexpensive. Because the corona ions will not be attracted by the shielding member 6 the charging width will not be made narrower and will be defined by the spacing between the shielding members. Thus, the charging spacing will be equal to the exposure slit.

Figure 6:
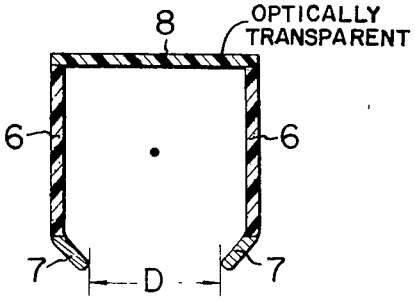
FIG. 6 shows a further embodiment in which transparent insulating material is provided at the upper opening of the discharger of FIG. 5.

In the fourth embodiment illustrated in FIG. 6, the opening defined by the insulating members 6, 6 at the top thereof is covered by a transparent member 8 which is made of acrylic resins, polyester resins, etc.

Figure 7:
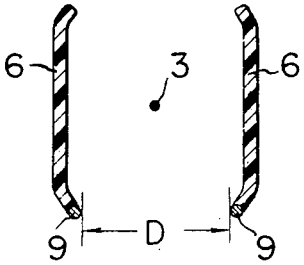
FIG. 7 shows the discharger wherein metallic wire is used for the metallic shield member.

In the fifth embodiment illustrated in FIG. 7, the metallic shielding members 7 attached to the lower side edges of the insulating member 6 in FIG. 5 are now in the form of wires 9.

Figure 8:
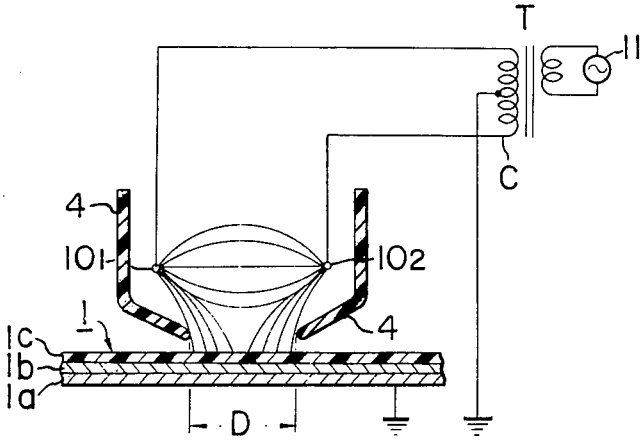
FIG. 8 shows a further embodiment in which two discharge electrodes are used, each electrode being energized with A.C. voltage 180° out of phase

FIG. 8 illustrates a modification of the first embodiment shown in FIG. 1. In this modification, a pair of discharge wires $10_1$ and $10_2$ are extended in parallel with each other. In a conventional charging device employing conductive shielding members, ions are not drawn to the photosensitive plate in the vicinity of the slit formed by the conductive shielding members but to the shielding member itself so that the effective charging region is narrower than the exposure slit or spacing D defined by the lower side edges of the shielding members. Therefore, the sensitivity of the plate is disadvantageously reduced. The modification illustrated in FIG. 8 has as its object to eliminate the above described defect.

Alternating currents which are out of phase by 180° relative to each other flow through the discharge wires $10_1$ and $10_2$ from a transformer T having its secondary C center-tapped and the ends of the secondary C coupled to the wires $10_1$ and $10_2$, respectively. Corona ions are reduced between the pair of discharge wires $10_1$ and $10_2$ due to the difference in potential between the pair of discharge wires $10_1$ and $10_2$ and many of these ions are attracted by the plate 1 in such manner that the charging spacing is confined to the space between the pair of discharge wires $10_1$ and $10_2$. Since the exposure slit D may be arbitarily selected by suitably arranging the lower side edges of the shielding member 4, the exposure slit or spacing can be completely coincident with the charging spacing. Furthermore, as in the case of the above described embodiments, no shield electrode (i.e., conductive member) is employed so that no undesired current flows through the shield plate and the power source may have a smaller capacity and be inexpensive.

Figure 9:
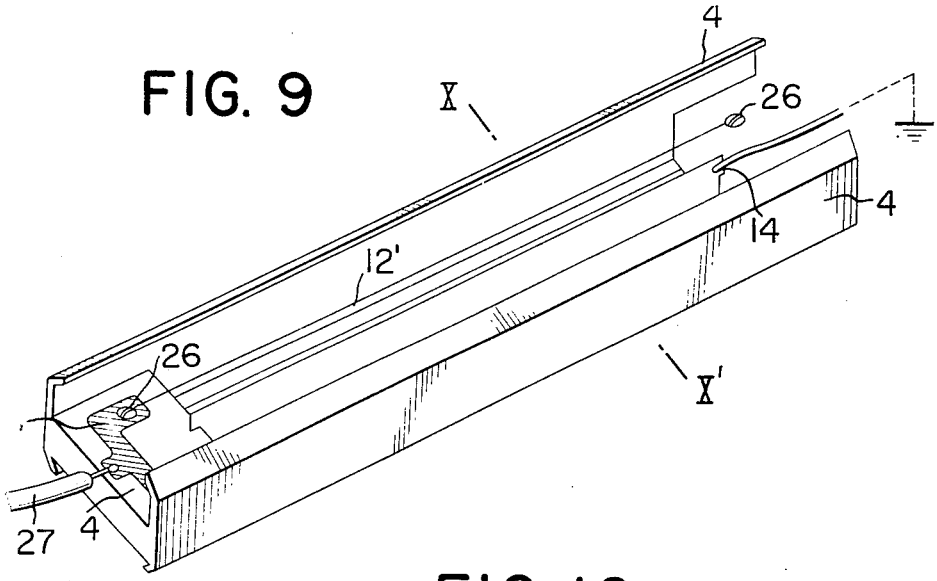
FIG. 9 shows a perspective view wherein a conductive grounded member is disposed between the two discharge electrodes of the embodiment of FIG. 8.
Figure 10:
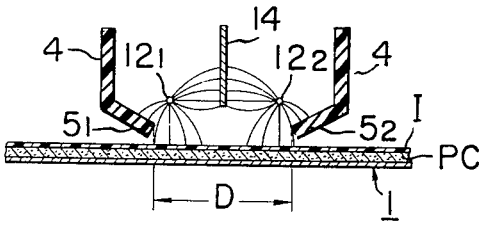
FIG. 10 shows a cross section of FIG. 9 taken along the line X–X'.

FIGS. 9 and 10 illustrate a further embodiment based upon the arrangement shown in FIG. 8. In this embodiment, between a pair of discharge wires $12_1$ and $12_2$ is interposed an electrically conductive grounding member 14 which is made transparently thin so that the projection of an image may not be adversely affected. Reference numeral 27 designates a lead wire; 25, a grounding plate; and 26, electrically conductive screws for holding the wires $12_1$ and 12hd 2 in position.

In this embodiment, because of the provision of the conductive grounding member 14 between the pair of discharge wires $12_1$ and $12_2$, and the insulating material surrounding the discharging electrode, the corona discharge is concentrated toward the central conductive grounding member 14 so that undesired current will not flow through the shielding plate surrounding the discharge wires. Thus, a power source having a smaller capacity may be advantageously employed for producing the same corona discharge as in the conventional system. If required, the grounding member 14 may be biased so that the discharge efficiency may be further increased.

Figure 11:
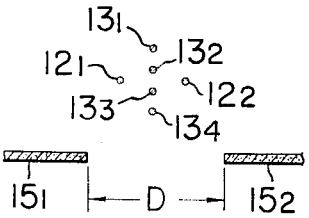
FIG. 11 shows a modification of the embodiment of FIG. 10, wherein the conductive grounded member is formed from metallic wires.

FIG. 11 illustrates a variation of the embodiment illustrated in FIG. 10. Instead of the grounding member 14, a plurality of wires $13_1$, $13_2$, $13_3$ and $13_4$ are disposed vertically in the same plane, and the slit D for exposure and charging is defined between a pair of insulating opaque shielding plates $15_1$ and $15_2$ which are made of polycarbonate, ABS, acrylic resins, tetrafluoroethylene resin, polyethylene, etc. The wires $13_1$ to $13_4$ may be biased when required.

Figure 12:
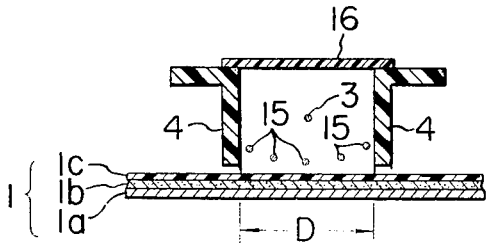
FIG. 12 shows a further embodiment provided with a shield electrode at or in the vicinity of the lower opening portion of the insulating material of FIG. 1.

The embodiment illustrated in FIG. 12 contemplates eliminating undesired exposure by making the charging slit exactly coincident with the exposure slit. The lower side edges of the insulating opaque members 4, 4 are spaced apart from each other by a distance equal to the width of the exposure slit D, and a plurality of fine diameter wires 15 are disposed at the slit or in the vicinity thereof so that the projection of an image is not adversely affected. Instead of the wires 15, a net having a coarse mesh may be used. A transparent electrode 16 made of, for example, NESA glass may be placed over the upper opening of the insulating members 4.

Figure 13:
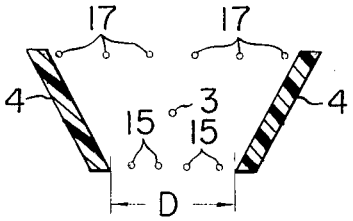
FIG. 13 shows a modification the embodiment of FIG. 12 wherein the insulating material has an upper opening larger than the lower opening.

In the embodiment illustrated in FIG. 13, the insulating members are arranged so as to diverge upwardly and wire electrodes 17 are disposed in the upper opening defined by the insulating members.

In both of the embodiments illustrated in FIGS. 12 and 13, the exposure slit width D is defined by the insulating opaque shielding members 4 and 4 and the corona discharge occurs between the shield wires in the slit and the discharge wire 3 so that the exposure slit coincides with the charging slit, whereby the defects encountered in the conventional device are eliminated.

Figure 14:
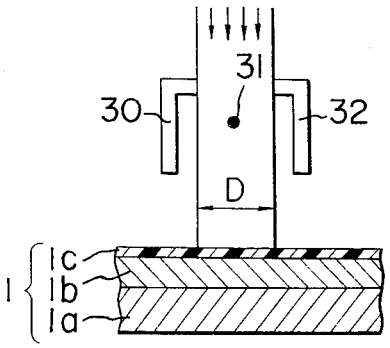
FIG. 14 shows a further embodiment in which the upper opening of the insulating material defines the exposure opening.

In the embodiments shown in FIGS. 8, and 10 through 13, it is of course possible to provide conductive members around the insulating material 4. Moreover, in the embodiments shown in FIGS. 1 through 13, the exposure width is determined by the lower opening of the discharging device, but it is possible to determine the exposure width by the upper opening of the device as shown in FIG. 14.

As described hereinabove, in the A.C. corona discharging device in accordance with the present invention for a process in which the discharging is effected contemporaneously with the exposure in electrophotography, insulating members are so disposed as to surround the discharge wire or electrode and define an opening for projecting an image so that the insulating material is alternately positively and negatively charged during every half-cycle, as distinguished from the conventional A.C. corona discharging device using conductive shielding members. Therefore the potential gradient is increased; the discharge efficiency is improved; and undesired current will not flow through the shielding members so that a small capacity and inexpensive power source may be advantageously used, thus eliminating the defects encountered in the conventional device.

Furthermore, in accordance with the present invention, the charging slit may be made completely coincident with the exposure slit by providing electrically conductive members upon or in the vicinity of the insulating members or by providing a pair of discharge wires or electrodes and interposing therebetween an electrically conductive grounding member or members so as to permit the flow of alternating currents differing in phase by 180°. It should be apparent that the opaque walls of the corona generating structure functions as a mask for framing the projected optical image and that the mask opening is the "exposure slit" as referred to herein.

What is claimed is:

1. An A.C. corona discharging system for applying a corona discharge to a photoconductive member having a conductive backing, and for contemporaneously projecting an optical image upon the member, comprising in combination: means for connecting the conductive backing of the member to a point of reference potential; an electrode, and means for supporting said electrode at a position spaced from said photoconductive member on the side remote from said backing, wherein said electrode and said photoconductive member are relatively movable for scanning the surface of the latter; means for connecting a source of alternating current voltage between said point of reference potential and said electrode for establishing a corona discharge between said electrode and said photoconductive member; and insulating material supported at a position spaced from said photoconductive member and surrounding said electrode to define an optical path for the projection of said image therethrough upon said photoconductive member, wherein said material is disposed to become oppositely charged during alternate half cycles of said source voltage for enhancing the corona discharge.

2. An A.C. corona discharging system according to claim 1, wherein said electrode is elongated, and said insulating material is in the form of a pair of elongated side wall elements spaced from said electrode on opposite sides thereof and extending substantially parallel thereto.

3. An A.C. corona discharging device for applying a corona discharge to a photoconductive member having a conductive backing, and for contemporaneously projecting an optical image upon the member, comprising in combination: means for connecting the conductive backing of the member to a point of reference potential; electrode means and means for supporting said electrode means at a position spaced from said photoconductive member on the side remote from said backing, wherein said electrode means and said photoconductive member are relatively movable for scanning the surface of the latter; means for connecting a source of alternating current voltage between said point of reference potential and said electrode means for establishing a corona discharge between said electrode means and said photoconductive member; and side wall members having insulating material supported at a position spaced from said photoconductive member and surrounding said electrode means to define an optical path for the projection of said image therethrough upon said photoconductive member, wherein said material is disposed to become oppositely charged during alternate half cycles of said source voltage for enhancing the corona discharge.

4. An A.C. corona discharging device according to claim 3, wherein electrically conductive shielding members are joined respectively to an exterior surface of the insulating material of each of said sidewall members remote from said electrode means, and wherein means are provided for connecting said shielding members to a point of reference potential.

5. An A.C. corona discharging device according to claim 3, wherein said side wall members have side edges remote from said photosensitive member for providing a mask for framing said projected image.

6. An A.C. corona discharging device according to claim 3, wherein said side wall members have side edges proximate to said photosensitive member for providing a mask for framing said projected image.

7. An A.C. corona discharging device according to claim 6, wherein said side wall members further comprise a pair of electrically conductive members joined respectively along and to the corresponding side edges of said insulating material, said conductive members being spaced apart to frame said projected image and being provided with means for connecting said members to a point of reference potential.

8. An A.C. corona discharging device according to claim 6, further comprising a plurality of shield wires disposed in the space between said side edges.

* * * * *

UNITED STATES PATENT AND TRADEMARK OFFICE

CERTIFICATE OF CORRECTION

PATENT NO. : 4,053,770

DATED : October 11, 1977

INVENTOR(S) : HIROSHI TANAKA, SHINKICHI TAKAHASHI, TOURU TAKAHASHI, SHUSEI TSUKADA and GIICHI MARUSHIMA It is certified that error appears in the above-identified patent and that said Letters Patent are hereby corrected as shown below:

Column 1, line 65, delete "durning" and insert --during--.

Column 2, line 60, after "phase" insert --;--.

Column 4, line 5, after "is" insert --grounded--;

line 40, after "wasted" insert --because of the narrow spacing.--.

Column 5, line 18, delete "reduced" and insert --produced--;

line 40, delete "12hd 2" and insert --$12_2$--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*